United States Patent [19]

Böcker

[11] Patent Number: 4,498,263

[45] Date of Patent: Feb. 12, 1985

[54] TELESCOPIC BEAM

[75] Inventor: Albert Böcker, Werne, Fed. Rep. of Germany

[73] Assignee: Albert Bocker GmbH & Co KG, Fed. Rep. of Germany

[21] Appl. No.: 420,408

[22] Filed: Sep. 20, 1982

[30] Foreign Application Priority Data

Sep. 23, 1981 [DE] Fed. Rep. of Germany ..... 3137846

[51] Int. Cl.[3] ..... B66C 23/06

[52] U.S. Cl. ..... 52/223 R; 52/121

[58] Field of Search ..... 52/223 R, 121, 111, 52/110, 115, 118

[56] References Cited

U.S. PATENT DOCUMENTS

| | | | |
|---|---|---|---|
| 2,795,303 | 6/1957 | Muehlhause et al. | 52/121 |
| 3,514,918 | 6/1970 | Archer et al. | 52/223 R |
| 3,674,157 | 7/1972 | Fikse | 52/121 X |
| 3,977,139 | 8/1976 | Bryant | 52/121 X |
| 4,183,440 | 1/1980 | Wilkinson | 52/223 R |

*Primary Examiner*—Karl Bell

*Attorney, Agent, or Firm*—George A. Evans

[57] ABSTRACT

A telescopic beam comprises a plurality of telescopically-interconnected members which define rails along which a load-carrying tub can move. Means are provided for locking the telescopic members together. The beam is provided with a pair of tensioning cables which bridge several of the telescopic members. The cables are guided by means of spacers attached to the telescopic members.

9 Claims, 3 Drawing Figures

FIG.1
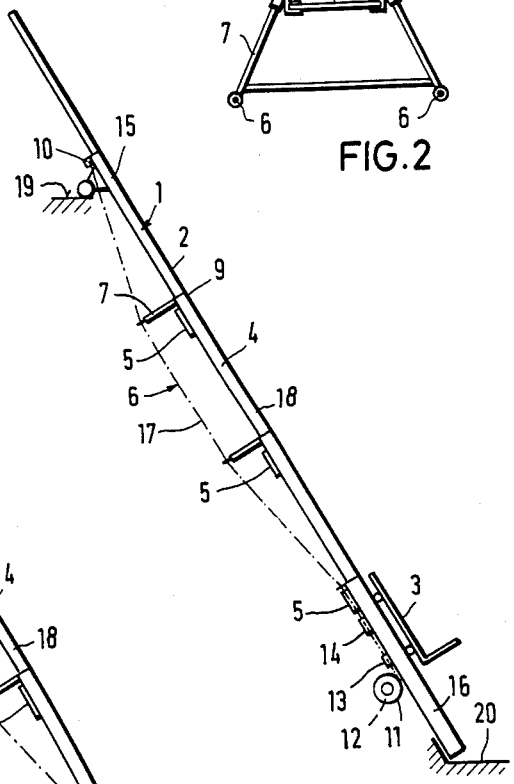
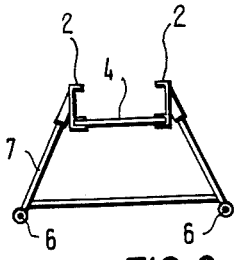
FIG.2
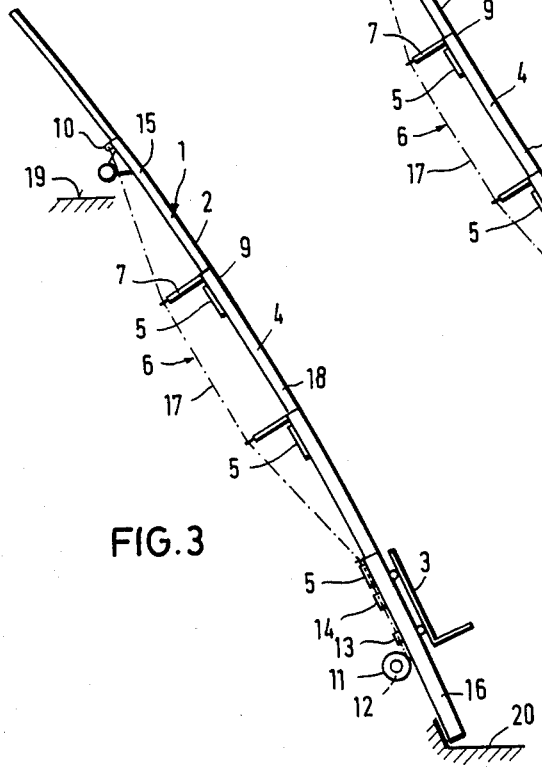
FIG.3

TELESCOPIC BEAM

BACKGROUND TO THE INVENTION

This invention relates to a telescopic beam, and in particular to a telescopic beam along which a load-carrying tub is movable.

It is known to provide such a telescopic beam with locking means for preventing retraction of the telescopic members comprising the beam. For example, it has been proposed (see DE-OS No. 3 001 420.9) to provide locking elements between each pair of adjacent telescopic members of such a telescopic beam. These locking elements are so designed that the beam can have any desired extended length.

Telescopic beams are often used as inclined hoists and are employed by, for example, roofing contractors and building firms. These beams are intended to enable loads, such as tiles or cement, to be raised. In use, the lower end of a telescopic beam of this type is supported on a fixed point, and the beam is then extended to such an extent that its upper end can be supported on another fixed point. Until it is supported at its upper end, the telescopic beam is, for practical purposes, a girder which is supported at one end only, and which deflects accordingly. The concave side of the beam, therefore, faces the ground. However, as soon as the upper end is supported, the beam becomes a girder which is supported at both ends, so that the convex side of the beam then faces the ground. This is the situation in which a tub (which may be carrying a heavy load) is to ascend on the rails formed by the telescopic beam. The smaller the angle between the ground and the telescopic beam, the greater is the bending load applied to the beam. However, since the telescopic beam has to be designed to cater for the maximum load, it has hitherto been necessary, particularly in the case of inclined hoists, to make use of unusually robust (and therefore expensive) constructions. With such a hoist, the maximum extended length of the beam may be as much as 40 meters. The deflection of the beam is, therefore, considerable; and this increases further under an applied load, particularly when this is located approximately at the midpoint between the two support points. If the length of the beam is then required to be adjusted, the loading applied to the beam can result in jamming between the telescopic members so that relative movement is no longer possible.

The aim of the invention is to provide a telescopic beam which does not suffer from the above-mentioned disadvantages.

SUMMARY OF THE INVENTION

The present invention provides a telescopic beam comprising a plurality of telescopically-interconnected members, and means for locking the telescopic members of any adjacent pair together in a pre-determined extended position, wherein the beam is provided with elongate tensioning means bridging several of said telescopic members, the elongate tensioning means being guided by means of spacers attached to said telescopic members.

Advantageously, the elongate tensioning means comprises a pair of cables. Alternatively, the elongate tensioning means may comprise a single cable.

In this arrangement, the cable or cables can be tensioned in any suitable manner, the only prerequisite being that the telescopic members should, in use, be locked together against retraction.

In a preferred embodiment, each of the telescopic members bridged by the elongate tensioning means is provided with a respective spacer adjacent to one end thereof. Preferably, each of the spacers is pivotally attached to its respective telescopic member. Conveniently, the spacers may be of stirrup formation.

A further object of the invention is to avoid the use of additional means for imparting tension to the cable or cables. Accordingly, one end of the or each cable may be attached to a winding roller around which the cables are windable, the winding roller being attached to a first-telescopic member at one end of the beam, the other end of each cable being attached to a stop member fixed to a second telescopic member adjacent to the other end of the beam. Advantageously, said second telescopic member is the telescopic member connected to the telescopic member at said other end of the beam. The winding roller forms a cable store, so that, with the cable or cables under slight preliminary tension, a cable bridge is automatically formed when the telescopic beam is extended. If the telescopic members are then locked together, the extended beam forms a girder which is supported at one end (its lower end). The telescopic beam deflects downwardly under gravity, so that the or each cable assumes a position in which it is at its shortest.

Preferably, said first telescopic member is provided with a cable-retaining device for clamping the cables against said first telescopic member, the cable-retaining device being positioned adjacent to the winding roller. Conveniently, the cable-retaining device is a clamp or a reverse brake. Once the cable-retaining device has been used to clamp the cable(s) to said first telescopic member, the cable(s) can no longer increase in length. If the upper end of the telescopic beam is then supported on a fixed point, the or each cable forms the equivalent of the string of a crossbow. The telescopic beam remains slightly downwardly bent and forms an ideal bridge for the load to be transported.

The first and second telescopic members are, therefore, bridged by the cable(s) which then form a tensioning chord, preferably positioned below the beam. The principle on which the invention is based is, of course, also suitable for providing the beam with an upper tensioning chord or lateral tensioning chords, depending on the envisaged uses.

The winding roller may be biased in the winding-up direction by any suitable means, for example, hydraulically, pneumatically, electrically (with the aid of a static motor) or by a spring. An actuating member, mounted on a control platform, may be provided for actuating the cable-retaining device.

The telescopic beam of the invention, enables fairly heavy loads to be transported over an inclined hoist without loading the individual telescopic members too heavily at their overlapping zones, and without the occurrence of jamming or the deformation of the members. The telescopic beam of the invention is also cheaper than known beams.

BRIEF DESCRIPTION OF THE DRAWINGS

A telescopic beam constructed in accordance with the invention will now be described in detail, by way of example, with reference to the accompanying drawings, in which:

FIG. 1 is a side elevation of the telescopic beam in the extended position in which it is supported at both ends;

FIG. 2 shows, on a larger scale, a transverse cross-section through the telescopic beam; and FIG. 3 shows the telescopic beam in the extended position in which it is supported at only one end.

DESCRIPTION OF PREFERRED EMBODIMENT

Referring to the drawings, FIG. 1 shows a telescopic beam 1 which defines a pair of rails 2 along which a load-carrying tub 3 can move. The telescopic beam 1 can, therefore, be used as an inclined hoist. The beam 1 is constituted by a plurality of telescopic members 4 which can be secured in their extended positions by locking elements 5. The beam 1 can be tensioned in its extended position by a pair of cables 6, each of which is guided over spacers 7. Each of the spacers 7 is pivotally attached to a respective telescopic member 4 adjacent to one end 9 thereof. In the retracted position of the telescopic beam 1, the spacers 7 form a compact group. Each of the cables 6 is secured to a stop 10 at the upper end of the telescopic member 15 which is adjacent to the uppermost telescopic member. The cables 6 pass over complementary guides (not shown) associated with the spacers 7, and over a cable-retaining device 14 and respective guides 13 to a biassed winding roller 11 which forms a cable store 12. The guides 13, the cable-retaining device 14 and the winding roller 11 are attached to the lowermost telescopic member 16. The roller 11 is biassed in the direction which tends to wind the cables 6 thereonto in any required manner, for example, hydraulically, pneumatically, electrically, or by means of a spring, so as to ensure constant tension in the cables. In a modified arrangement, a respective cable-retaining device 14 and a respective winding roller 11 may be provided for each of the cables 6. It would also be possible to tension the beam 1 using only one cable 6.

As the telescopic members 4 are extended, the spacers 7 move progressively further away from each other as they ride over the cables 6, which are constantly increased in length by being wound off the winding roller 11. When the required extended position is reached, the cable-retaining device 14 is brought into operation. This device 14 may be, for example, a reverse brake or a clamp. Thus, the cables 6 pass from the stops 10 (which are positioned on the underneath side of the telescopic beam 1) as far as the cable-retaining device 14 on the lowermost telescopic member 16. Consequently, the telescopic member 16, together with all the other telescopic members up to the telescopic member 15, forms a beam 18 rigidised by the cables 6. In this position (see FIG. 3) the beam 1 is supported only at its lower end, and so it bends in the manner of a loosely-held fishing rod (the extent of the bending being dependent upon the inclined position), so that each of the cables 6 takes up a configuration similar to the string of a crossbow. Once the cable-retaining device 14 is brought into operation, this bowed position cannot change to any substantial extent. The upper end of the telescopic member 15 is then supported on a fixed member 19, so that the beam 1 is supported at both ends. The beam 1 will then tend to deflect downwardly, especially when a heavy load-carrying tub 3 is being transported on it. The forces which deflect the beam 1 in this manner will then tension the cables 6, without separate tensioning devices being required.

The cable tension may, of course, also be increased by bringing the cable-retaining device 14 into operation shortly before the required extended position is reached, so that the tension in the cables 6 is increased by the final part of the relative displacement of the telescopic members 4.

It will be apparent that the telescopic beam described above could be modified in a number of ways. For example, means could be provided for automatically retracting the telescopic members. Preferably, this is done by providing the winding roller 11 with an additional drive which acts in the wind-on direction. The bias, which is in any case present in the wind-on direction can also be so selected that the cable or cables 6 reinforce retraction.

I claim:

1. In a telescopic beam having a plurality of telescopically-interconnected members and means for locking the members of any adjacent pair together in a predetermined extended position, the improvement which consists in utilizing elongate tensioning means bridging several of said telescopic members, the elongate tensioning means being guided by means of spacers attached to said telescopic members, the elongate tensioning means comprising at least one cable, wherein one end of said at least one cable is attached to a winding roller around which said at least one cable is windable, the winding roller being attached to a first telescopic member at one end of the beam, the other end of said at least one cable being attached to a stop member fixed to a second telescopic member adjacent to the other end of the beam.

2. A telescopic beam according to claim 1, wherein the elongate tensioning means comprises a pair of cables.

3. A telescopic beam according to claim 1, wherein each of the telescopic members bridged by the elongate tensioning means is provided with a respective spacer adjacent to one end thereof.

4. A telescopic beam according to claim 3, wherein each of the spacers is pivotally attached to its respective telescopic member.

5. A telescopic beam according to claim 1, wherein said second telescopic member is the telescopic member connected to the telescopic member at said other end of the beam.

6. A telescopic beam according to claim 2, wherein said first telescopic member is provided with a cable-retaining device for clamping the cables against said first-telescopic member, the cable-retaining device being positioned adjacent to the winding roller.

7. A telescopic beam according to claim 6, wherein the cable-retaining device is a clamp.

8. A telescopic beam according to claim 1, further comprising a load-carrying tub which is movable to-and-fro along rails defined by the telescopic members.

9. In a telescopic beam having a plurality of telescopically-interconnected members, each of which includes guide rail means, locking elements for locking the telescopic members of any adjacent pair together in a predetermined extended position, and a load-carrying tub movable to-and-fro along said guide rail means, the improvement which consists in utilizing at least one cable bridging several of said telescopic members, said at least one cable being guided by means of spacers attached to said telescopic members, wherein one end of said at least one cable is attached to a winding roller around which said at least one cable is windable, the winding roller being attached to a first telescopic member at one end of the beam, the other end of said at least one cable being attached to a stop member fixed to a second telescopic member adjacent to the other end of the beam, and wherein said first telescopic member is provided with a cable-retaining device for clamping said at least one cable against said first telescopic member, the cable-retaining device being positioned adjacent to the winding roller.

* * * * *